United States Patent [19]

Hoshino et al.

[11] Patent Number: 4,461,346

[45] Date of Patent: Jul. 24, 1984

[54] FEEDWATER HEATER

[75] Inventors: Yoshiyuki Hoshino; Shyuichi Imazu, both of Hitachi; Masahiko Miyai, Mito; Yoshikuni Oshima, Hitachi; Masakiyo Izumiya, Mito, all of Japan

[73] Assignee: Hitachi, Ltd., Tokyo, Japan

[21] Appl. No.: 306,234

[22] Filed: Sep. 28, 1981

[30] Foreign Application Priority Data

Sep. 29, 1980 [JP] Japan ..... 55-134330

[51] Int. Cl.[3] ..... F28B 9/10

[52] U.S. Cl. ..... 165/114; 165/160; 165/161; 122/441

[58] Field of Search ..... 165/114, 162, 161, 160; 122/441

[56] References Cited

U.S. PATENT DOCUMENTS

| | | | |
|---|---|---|---|
| 1,764,716 | 6/1930 | Ehrhart | 165/114 |
| 2,021,009 | 11/1935 | Ireland | 165/162 |
| 2,180,840 | 11/1939 | Tuley et al. | 165/114 |
| 3,706,301 | 12/1972 | Penfield, Jr. | 165/114 |
| 3,795,273 | 3/1974 | Brigida et al. | 165/114 |
| 3,938,588 | 2/1976 | Coit et al. | 165/114 |
| 4,219,077 | 8/1980 | Furukawa et al. | 165/114 |
| 4,249,485 | 2/1981 | Brul et al. | 122/441 |
| 4,254,825 | 3/1981 | Imazu | 165/114 |

FOREIGN PATENT DOCUMENTS

| | | | |
|---|---|---|---|
| 54-68555 | 6/1979 | Japan | 165/114 |

*Primary Examiner*—Albert W. Davis, Jr.
*Assistant Examiner*—S. Gayle Dotson
*Attorney, Agent, or Firm*—Antonelli, Terry & Wands

[57] ABSTRACT

A horizontal feedwater heater for use in heat power stations, of the type having a shell, a plurality of U-bent heat transfer tubes extended in the longitudinal direction of the shell and a vent tube extended in the longitudinal direction of the shell substantially at the center of the latter and adapted for extracting and discharging non-condensed gas. The feedwater heater has a baffle disposed at each side of the vent tube and having a horizontal plate portion extended horizontally from the vent tube and an inclined plate portion inclined downwardly from the end of the horizontal plate portion at an obtuse angle to the latter. The length of projection of the baffle from the vent tube is varied along the length of the shell in accordance with the ratio of amount of heat exchanged between the steam and feedwater in each axial section of the tube nest connected to the water inlet to the amount of heat exchanged between these fluids in the corresponding tube nest section of the feedwater outlet side, thereby to permit an efficient extraction of the non-condensed gas. The structural members connectable with the heating steam is made from a low alloy steel containing more than 1% of Cr to exhibit a high corrosion resistance.

10 Claims, 9 Drawing Figures

FEEDWATER HEATER

BACKGROUND OF THE INVENTION

The present invention relates to a feedwater heater for use in heat power stations or nuclear power stations and, more particularly, to a feedwater heater of the type having a multiplicity of U-shaped heat transfer tubes and a vent tube for discharging the non-condensed gas in the heater.

Specifications of U.S. Pat. Nos. 4,254,825 and 4,219,077, assigned to the same assignee as this application, disclose a feedwater heater for the uses mentioned above. A brief description will be made as to the general construction of the feedwater heater common to these references. The feedwater heater of a horizontal type has a barrel or a shell, the inside of which is divided into sections by a tube plate which is normal to the axis of the shell. More specifically, at one end of the shell, a water chamber section is defined that consists of a water inlet chamber having a water inlet opening and a water outlet chamber having a water outlet opening. A plurality of heat transfer tubes are bent at their mid portions and are extended along the axis of the shell. These tubes are fixed to the tube plate such that one end of each tubes opens in the water inlet chamber, while the other end opens in the water outlet chamber. The heat transfer tubes are supported by a plurality of tube supporting plates, spaced at a suitable pitch in the longitudinal direction of the tubes. An inlet opening for steam and a drain are formed in the top of the shell. Also, a vent tube for discharging the non-condensed gas is disposed between the tube nest of the water inlet side, i.e. the lower tube nest, and the tube nest of the water outlet side, i.e. the uper tube nest, to permit the discharge of the non-condensed gas.

In operation, the feedwater coming into the feedwater heater from the water inlet chamber flows through the U-shaped heat transfer tubes and absorbs the heat from the heating steam coming into the feedwater heater from the steam inlet opening to condense the steam. The condensate is collected at the bottom of the shell and is discharged to the outside through a drain cooler which is located near the tube plate and surrounding the tube nest of the feedwater inlet side.

In the feedwater heater of this kind having more than one turn of the flow of feedwater, there is a large temperature difference of the feedwater between the tube nest of the feedwater inlet side and the tube nest of the feedwater outlet side. In consequence, the ratio of amount of heat exchanged in the inlet side tube nest to the amount of heat exchanged in the outlet side tube nest is as large as 20:1, so that a region of stagnation of steam is formed in the feedwater inlet side tube nest of the greater heat exchange. The non-condensed gas is inconveniently accumulated in this region. In consequence, the non-condensed gas is not concentrated to the vent tube and, hence, cannot be discharged smoothly, resulting in a corrosion of the heat transfer tubes in this region, as well as deteriorated transfer of the heat.

SUMMARY OF THE INVENTION

Accordingly, an object of the invention is to provide a feedwater heater which is free from the problem of corrosion of the shell, tube plate and tubes due to the stagnation of the non-condensed gas, while maintaining a high heat exchanging performance.

Another object of the invention is to provide a feedwater heater constructed with a material having a high resistance against corrosion even in the atmosphere where the saturated steam of high temperature and non-condensed gas exist together.

To these ends, according to the invention, there is provided a feedwater heater having a plurality of U-shaped heat transfer tubes arranged to form a lower tube nest disposed at the feedwater inlet side and an upper tube nest disposed at the feedwater outlet side, and a vent tube disposed between the upper and the lower tube nest and adapted for discharging non-condensed gas, the feedwater heater comprising baffles attached to the vent tube and adapted to interrupt the flow of steam coming down from the upper tube nest into the lower tube nest, the projection lengths of the baffles being varied along the length of the feedwater heater in accordance with the change of ratio of amount of heat exchanged between the feedwater and the steam in the lower tube nest to the amount of heat exchanged between the feedwater and the steam in the upper tube nest.

The above and further objects and novel features of the invention will more fully appear from the following detailed description when the same is read in conjunction with the accompanying drawings. It is to be expressly understood, however, that the drawings are for purpose of illustration only and are not intended as a definition of the limits of invention.

BRIEF DESCRIPTION OF THE DRAWINGS

FIG. 7(*b*) is a diagram showing the baffle length in relation to each tube nest section.

DESCRIPTION OF THE PREFERRED EMBODIMENTS

Figure 1:
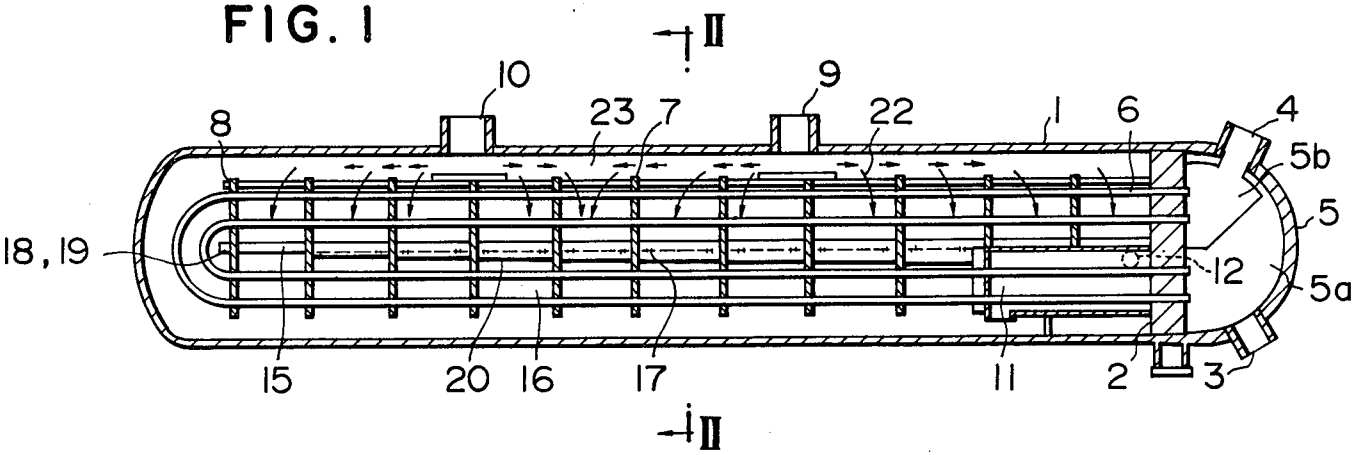
FIG. 1 is a longitudinal sectional view of a feedwater heater.
Figure 2:
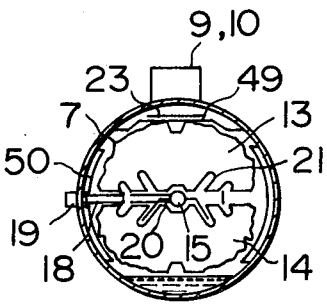
FIG. 2 is a sectional view taken along the line II—II of FIG. 1.

Referring to FIG. 1, a feedwater heater of the invention has a horizontally mounted shell 1, the inside of which is divided by a tube plate 2 into a water chamber section 5 defined at one end of the shell 1 and a steam chamber section. The water chamber section is further sectioned into an inlet chamber 5*a* having a feedwater inlet 3 and a water outlet chamber 5*b* having a feedwater outlet 4. A plurality of heat transfer tubes 6 are arrayed in the form of a tube nest along the length of the shell 1.

Each heat transfer tube is bent in a U-like shape at its mid portion. The heat transfer tubes 6 are fixed at their both ends to the tube plate 2 such that one of their ends opens to the water inlet chamber 5*a*, while the other of their ends opens to the water outlet chamber 5*b*. The heat transfer tubes 6 are supported by a plurality of tube supporting plates 7 which are perpendicular to the axis of the shell 1 and spaced in the longitudinal direction of the same. The tube supporting plates 7 are secured to the tube plate 2 by means of tie rods 8. A steam inlet opening 9 and a drain inlet opening 10 are formed in the top surface of the shell 1. A drain cooler 11 for cooling the condensate or drain in the shell 1 is disposed in the vicinity of the tube plate 2 in such a manner as to surround the tube nest of the feedwater inlet side. The drain accumulated on the bottom of the barrel is sucked up into the cooler 11 through an inlet formed in the lower face of the cooler 11 to fill the cavity in the latter, and is discharged from the drain discharge port 12 by means of a drain pump.

A vent tube 15 for discharging the non-condensed gas is attached to a portion between the tube nest 14 of the feedwater inlet side (lower tube nest) and the tube nest 13 of the feedwater outlet side (upper tube nest), to permit the discharge of the non-condensed gas to the outside of the shell.

The vent tube 15 is provided with orifice holes 17 located in each section 16 of the tube nest defined by the tube supporting plates. The diameters of these orifice holes are determined to correspond to the amounts of heat exchanged in respective sections 16. The non-condensed gas attracted through these orifice holes 17 is made to flow across the tube nest through a guide tube 18 connected to the end of the vent tube 15, and is discharged through a vent seat 19 to a deaerator or a condenser maintained at a pressure sufficiently lower than the pressure in the feedwater heater.

Gas collecting baffles 20 are secured to both sides of the vent tube 15 to extend along the length of the latter. The tube nest has vacant spaces 21 to permit the baffles 20 to pass therethrough. Each tube supporting plate 7 is provided with an upper notch 49 to permit the steam coming into each tube nest section 16 through the steam inlet opening 9 to freely flow as indicated by an arrow 22, so as to form a passage 23 for the steam.

In operation of the feedwater heater having the described consturction, the steam, steam-drain mixture and the drain coming through the steam and drain inlet openings 9, 10 are made to expand in the space of the passage 23 so that the steam flows over all tube nest sections 16 of the whole length of the feedwater heater. Thus, the sectional area of the flow passage for the steam is sufficiently increased to sufficiently lower the flowing velocity of the steam. In the conventional feedwater heaters, tube supporting plates notched at the upper side and the tube supporting plates notched at the lower side are arranged alternatingly, so that the steam passage is wound up and down to have a small sectional area to cause a considerably high flowing velocity of the steam, with a consequence to promote the corrosion and erosion of the tubes. According to the invention, however, this problem is eliminated because the flowing velocity of the steam can be lowered sufficiently.

In the feedwater heater of the invention, each tube supporting plate 7 is notched also at its lateral sides as at 50 so that the steam passages are formed also at both side portions of the shell 1. It is, therefore, possible to release the steam accumulated in one tube nest section 16 to another tube nest section 16 of a lower pressure to achieve a flow pattern corresponding to the heat exchanging capacities of respective tube nest sections 16.

The shell 1 and the internal structure is made of a steel containing more than 1% of Cr to exhibit a sufficient corrosion and erosion resistances. In the conventional feedwater heaters, the shell and the internal structure are made of a carbon steel so that, when the steam-water mixture coming through the drain inlet opening 10 and the steam coming through the steam inlet opening 9 have low pH values, the corrosion and erosion proceed rapidly. Particularly, the reduction of wall thickness of the shell is serious.

Figure 8:
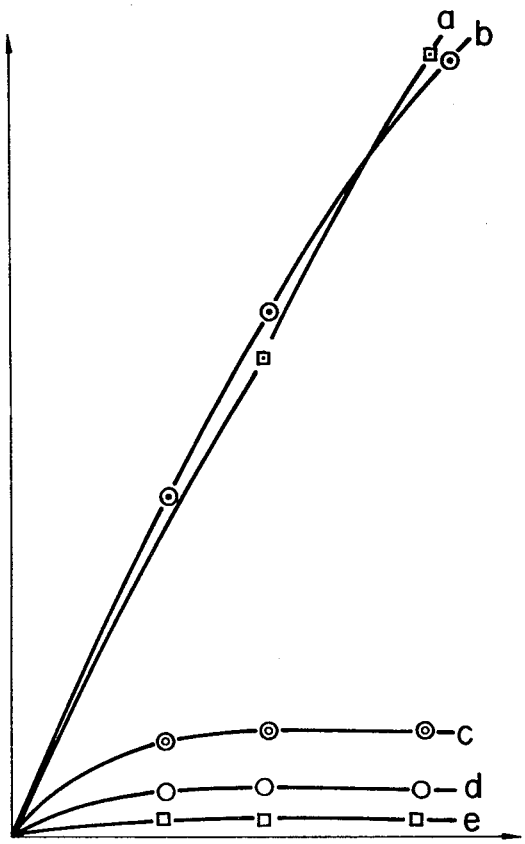
FIG. 8 is a diagram showing corrosion characteristics of various steel materials.

To find out a good solution to this problem, the present inventors have made an experiment to examine the corrosion and erosion resistances of various steel materials, the result of which is shown in FIG. 8.

More specifically, the experiment was conducted to investigate the corrosion loss (mg/dm$^2$) of (a) 0.2%C carbon steel, (b) 0.3%C carbon steel containing Cu, (c) 0.3%C carbon steel containing Cr, Ni and Cu, (d) 1.3%Cr-0.5%Mo steel and (e) 2.3%Cr-1.0%Mo steel, under the condition of: temperature 150° C., oxygen concentration less than 4 ppb, flowing velocity 2 m/sec and pH 7 (neutral).

The result of experiment showed that the corrosion and erosion resistances of the steel are very much improved by the presence of the Cr content. Particularly, it was confirmed that the steel material having a Cr content in excess of 1% exhibit sufficient corrosion resistances.

Figure 3:
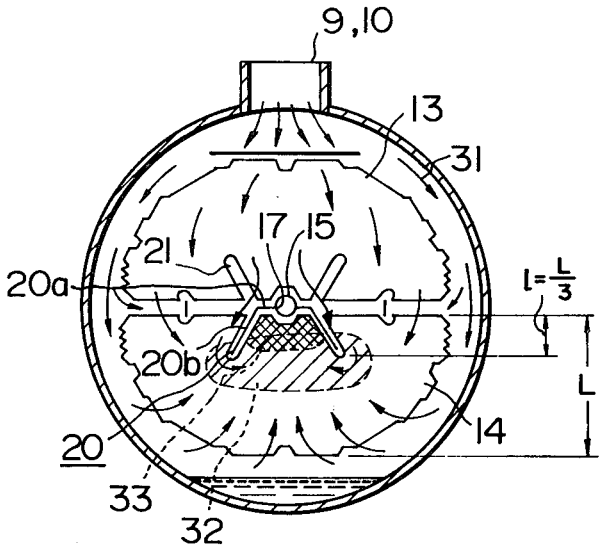
FIGS. 3 to 5 are enlarged views of the construction shown in FIG. 2 and showing how the region of stagnation of the non-condensed gas is affected by the ratio of amount of heat exchange and the length of the baffle.

Referring to FIG. 3, as stated before, gas collecting baffles 20 are secured to both sides of the vent tube 15 in such a manner as to interrupt the flow of steam from the tube nest 13 of the feedwater outlet side. It is, therefore, possible to form a low pressure region 33 adjacent to the region 32 of stagnation of the non-condensed gas and, accordingly, the non-condensed gas can be efficiently sucked through the vent tube 15. More specifically, the steam coming into the shell 1 through the steam inlet opening 9 flows as indicated by the arrow 22 in FIG. 1, and then flows downwardly from the upper tube nest 13 to the lower tube nest 14 as indicated by an arrow 31 in FIG. 3. In the conventional feedwater heater, it is not possible to efficiently concentrate the non-condensed gas to the area around the vent tube 15 with a consequence to lower the efficiency of extraction of the non-condensed gas.

This problem, however, is overcome by the present invention as will be understood from the following description. Namely, according to the invention, gas collecting baffles 20 are attached to both sides of the vent tube 15. Each baffle has a horizontal plate portion 20*a* projected laterally from one side of the vent tube 15 into the descending flow of the steam and an inclined plate portion 20*b* extended obliquely downwardly from the end of the horizontal plate portion 20*a* toward the tube nest 14 of the feedwater inlet side, i.e. the lower tube nest, at an obtuse angle to the horizontal plate portion 20*a*. Thus, two baffles 20 are arranged in a manner to diverge toward the lower side. In consequence, the steam coming down from the upper tube nest collides with the baffles 20 and is made to flow downwardly in a diverging manner into the lower tube nest 14 along the inclined plate portions 20*b* of the baffles 20. The steam is then condensed and accumulated on the bottom of the shell, while the non-condensed gas is induced to the low pressure region 33 defined by the inclined plate portions 20*b* of two baffles 20 and is then sucked into the vent tube 15.

An experiment showed, however, that the above-described effect of the provision of the baffles 20 is not achieveable in all tube nest sections. Namely, in the tube nest section where the ratio of amount of heat exchange between the upper and lower tube nests is as small as 1:1.5, a steam flow pattern as shown in FIG. 4 is formed when the baffles of the same size are used, to permit the region 32 of non-condensed gas stagnation to spread also to the area above and sideways of the baffles 20.

Figure 4:
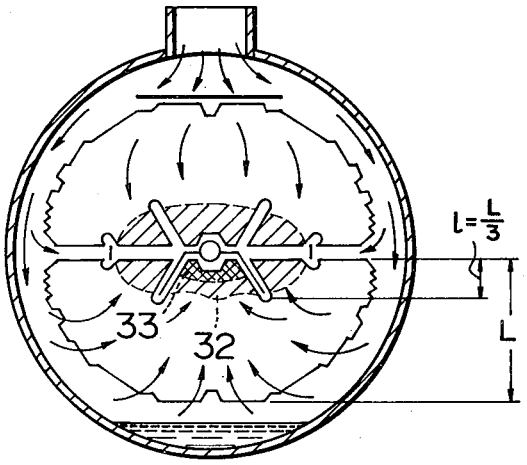

This phenomenon is attributable to the fact that, in the tube nest section shown in FIG. 4, the ratio of amount of heat exchange between the upper tube nest 13 and the lower tube nest 14 is smaller than that in the tube nest section shown in FIG. 4. An explanation will be given hereinunder as to the definition of the term "ratio of amount of heat exchange" hereinunder with specific reference to FIG. 6.

Figure 6:
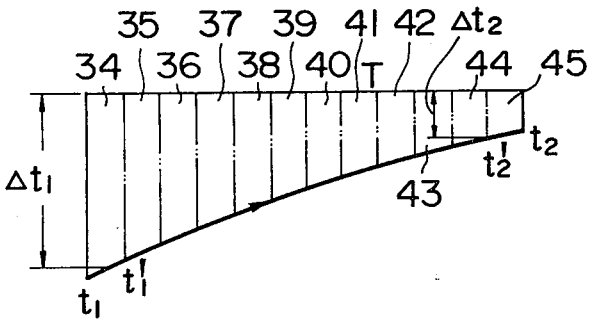
FIG. 6 is a temperature characteristics of each tube nest section.

FIG. 6 shows the temperature characteristics in the feedwater heater. Symbols used in FIG. 6 represent the following factors, respectively.

T: steam saturation temperature at steam side (°C.)

$t_1$: feedwater inlet temperature (°C.)

$t_2$: feedwater outlet temperature (°C.)

$\Delta t_1$: temperature difference between steam side and feedwater side at feedwater inlet side (°C.)

$\Delta t_2$: temperature difference between steam side and feedwater side at feedwater outlet side (°C.)

Reference numerals 34 to 45 denote tube nest sections in accordance with the flow of the feedwater. Namely, the reference numeral 34 denotes the first tube nest section, i.e. the feedwater inlet side section (lower tube nest section), while the reference numeral 45 denotes the last tube nest section (upper tube nest section). The steam temperature T of the steam side is the saturation temperature corresponding to the steam pressure in the steam side of the feedwater heater.

In operation, the feedwater flows into the inlet side section 34 at the inlet temperature $t_1$ and is heated up to $t_1'$ as it reaches the upsteam end of the lower tube nest section 35. The feedwater is then progressively heated as it flows through successive tube nest sections, and reaches the temperature $t_2'$ when it leaves the upper tube nest section 44 and is finally discharged from the feedwater heater at the final outlet temperature $t_2$.

Assuming here that the upper and lower tube nest sections 34 to 45 have an equal heating area S ($m^2$) and an equal overall heat transmission coefficient K (Kcal/$m^2$·hr·°C.) (coefficient K can be regarded as being materially equal), the amount of heat exchanged in each tube next section is given by the following equation.

$$Q=KS\Delta t \text{ (Kcal/hr)}$$

where, $\Delta t$ represents the temperature difference between the steam side and the feedwater side in each tube nest section.

From the above equation, it is derived that the amount of heat exchanged in the inlet side tube nest section 34 is represented by $Q=KS\Delta t_1$, while the amount of heat exchanged in the outlet side tube nest section 45 is represented by $Q=KS\Delta t_2$. Since the coefficient K and the area S are assumed to be constant, the amounts of heat exchanged are proportional to the temperature difference $\Delta t$ which varies according to sections as will be realized from FIG. 6. The section 34 of the lower tube nest 14 and the section 45 of the upper tube nest 13 take the same position in the axial or longitudinal direction of the shell 1. Thus, there is a large difference of amount of heat exchanged, between the section 34 of the lower tube nest 14 and the section 45 of the upper tube nest 13 taking the same axial position as the section 34. The ratio of the amount of heat exchanged in a tube nest section of the lower tube nest to that exchanged in the corresponding tube nest section in the upper tube nest is referred to as "ratio of the amount of heat exchanged", in this specification. Thus, the ratio of the amount of heat exchanged is greatest in the sections closest to the tube plate 2. This ratio generally takes a value of about 1:5 in the case of nuclear power plants and about 1:20 in the case of ordinary heat power stations. The ratio of the amount of heat exchanged is gradually lowered toward the bend end of the tube nest, and takes a value of about 1:1 in the sections closest to the bent end of the tubes.

This variation of the value of the ratio of the amount of heat exchanged creates various conditions concerning the flow rates and velocities of the steam coming down from the upper tube nest and the steam upwardly induced into the low-pressure region formed by the baffles.

Figure 5:
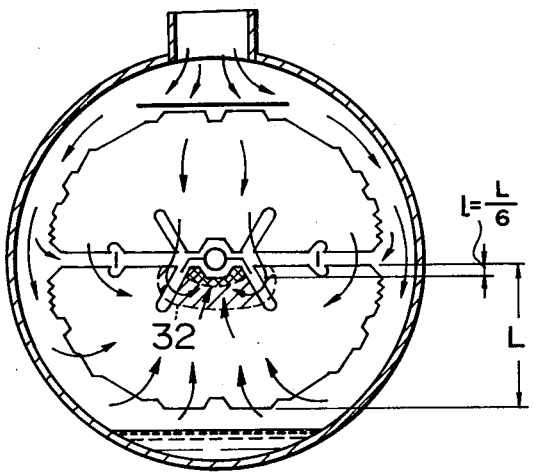

For instance, in the tube nest sections shown in FIG. 4 where the ratio of amount of heat exchanged is about 1:1.5, the upward flow of steam becomes dominant to spread the region 32 of stagnation of the non-condensed gas to the area surrounding the baffles 20, if the size l of the baffle 20 is selected to be large. To obviate this problem, it is preferred to select the length of the baffle 20 to be short correspondingly to the ratio of the amount of heat exchanged, as will be seen from FIG. 5 showing tube nest sections where the above-mentioned ratio is about 1:1.5. By so doing, it is possible to efficiently and continuously induce the non-condensed gas.

Figure 7A:
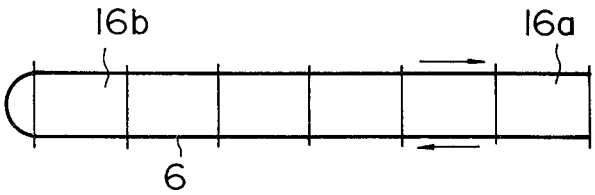
FIG. 7(*a*) is a schematic illustration of each tube nest section of the shell.
Figure 7B:
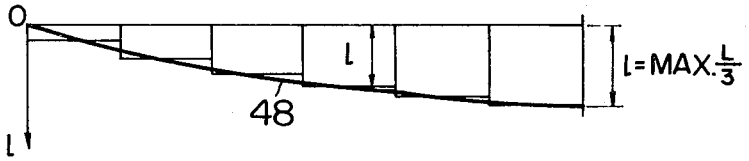

FIGS. 7(*a*) and 7(*b*) show the preferred relationship between the axial position of the tube nest sections and the length l of the baffles for collecting the non-condensed gas. The baffle length takes the maximum value in the tube nest section 16*a* closest to the tube plate. This maximum length preferably amounts to $\frac{1}{3}$ (one third) of the depth L of the tube nest. The preferred baffle length l is gradually decreased toward the tube nest section 16*b* closest to the U bend of the tubes. Thus, the length l of the baffles is preferably determined following the curve 48 in FIG. 7(*b*) along the longitudinal axis of the feedwater heater.

While a preferred embodiment of the invention has been described using specific terms, such description is for illustrative purpose only, and it is to be understood that changes and variations may be made without departing from the spirit or scope of the following claims.

What is claimed is:

1. In a feedwater heater having a shell defining a feedwater heating chamber and provided with a piping for introducing at least one heating fluid into said feedwater heating chamber, a plurality of U-bent heat transfer tubes extended in the longitudinal direction of said shell in such a manner as to form an upper tube nest and a lower tube nest, a water chamber section formed at one end of said shell and having a water inlet chamber to which one of said tube nest is connected and a water outlet chamber to which the other of said tube nests is connected, a vent tube disposed between said tube nests and adapted for extracting and discharging non-condensed gas, and a plurality of tube supporting plates arranged to support said heat transfer tubes and said vent tube at a plurality of points spaced in the longitudinal direction of said shell at a predetermined pitch, an improvement which comprises a baffle disposed along said vent tube and adapted to interrupt the flow of said heating fluid from said upper tube nest into said lower tube nest in the area around said vent tube, said baffle having a horizontal portion projecting from each of opposite sides of said vent tube and an inclined portion extending into said one of the tube nests from an end of each horizontal portion, the length of said inclined portion being varied so as to have a shortest length at the furthest distance longitudinally of said shell from said water chambers.

2. A feedwater heater as claimed in claim 1, wherein at least one of said shell, vent tube and tube supporting plates is made from a low alloy steel having a Cr content in excess of 1%.

3. A feedwater heater as claimed in claim 1, wherein each of said tube supporting plates is notched at its upper portion to provide a passage for the heating fluid in said upper tube nest.

4. A feedwater heater as claimed in claim 1, wherein each of said tube supporting plates is notched at its both side portions to provide passages for the heating fluid at both sides of said tube nests.

5. In a feedwater heater having a shell defining a feedwater heating chamber and provided with a piping for introducing at least one heating fluid into said feedwater heating chamber, a plurality of U-bent heat transfer tubes extended in the longitudinal direction of said shell in such a manner as to form an upper tube nest and a lower tube nest, a water chamber section formed at one end of said shell and having a water inlet chamber to which one of said tube nests is connected and a water outlet chamber to which the other of said tube nests is connected, a vent tube disposed between said tube nests and adapted for extracting and discharging non-condensed gas, and a plurality of tube supporting plates arranged to support said heat transfer tubes and said vent tube at a plurality of points spaced in the longitudinal direction of said shell at a predetermined pitch, in such a manner as to divide said tube nests into a plurality of tube nest sections, each including an upper tube nest section and a lower tube nest section, an improvement which comprises a baffle disposed along said vent tube and adapted to interrupt the flow of said heating fluid from said upper tube nest into said lower tube nest in the area around said vent tube, the length of projection of said baffle from said vent tube being varied such that the portion of said baffle in each of said tube nest sections has a projecting length that is respectively longer or shorter than the projecting length in an adjacent tube nest section in correspondence with an increase or decrease in a ratio of the amount of heat exchanged between said feedwater and said steam in said lower tube nest section to the amount of heat exchanged between said feedwater and said heating fluid in said upper tube nest section belonging to the same tube nest section relative to said ratio in said adjacent tube section.

6. A feedwater heater as claimed in claim 5, wherein said baffle has horizontal plate portions extending horizontally and laterally from both sides of said vent tube and inclined plate portions extended laterally from the ends of said horizontal plate portions toward said tube nest connected to said water inlet chamber, at a predetermined angle to said horizontal plate portions.

7. A feedwater heater as claimed in claim 6, wherein said predetermined angle is an obtuse angle.

8. A feedwater heater as claimed in claim 5, wherein the projecting length of said baffle is greater in the tube nest section closest to said water chambers and decreases gradually in a direction toward the tube nest section closest to the U-bent ends of the heat transfer tubes.

9. A feedwater heater as claimed in claim 8, wherein the maximum projecting length of said baffle is one-third of the depth of the lower tube nest.

10. A feedwater heater as claimed in claim 5, wherein the maximum projecting length of said baffle is one-third of the depth of the lower tube nest.

* * * * *